US009305525B2

(12) United States Patent
Park et al.

(10) Patent No.: US 9,305,525 B2
(45) Date of Patent: Apr. 5, 2016

(54) INTERCHANGEABLE GUITAR FACEPLATE AND GUITAR BODY SYSTEM

(71) Applicant: The Research Assembly Workshop, LLC, Pittsburgh, PA (US)

(72) Inventors: Jonnathan Kang Park, Irving, TX (US); Timothy Scott Emery, Jr., Charleroi, PA (US)

( * ) Notice: Subject to any disclaimer, the term of this patent is extended or adjusted under 35 U.S.C. 154(b) by 0 days.

(21) Appl. No.: 14/803,565

(22) Filed: Jul. 20, 2015

(65) Prior Publication Data

US 2016/0019870 A1 Jan. 21, 2016

Related U.S. Application Data

(60) Provisional application No. 62/027,023, filed on Jul. 21, 2014.

(51) Int. Cl.
*G10D 1/08* (2006.01)

(52) U.S. Cl.
CPC ..... *G10D 1/085* (2013.01)

(58) Field of Classification Search
CPC ..... G10D 1/08; G10D 1/085; G10D 1/00; G10D 3/00; Y10T 29/49826; G10H 1/32; B44C 1/26; B44C 3/02
USPC ..... 84/267, 290, 292
See application file for complete search history.

(56) References Cited

U.S. PATENT DOCUMENTS

2008/0236360 A1* 10/2008 Higgs ..... G10D 1/08 84/291
2012/0272808 A1* 11/2012 Kim ..... G10D 1/08 84/291

* cited by examiner

*Primary Examiner* — Kimberly Lockett
(74) *Attorney, Agent, or Firm* — Acker Wood IP Law LLC; Gwen R. Acker Wood

(57) ABSTRACT

The present invention provides an interchangeable, custom-designed guitar faceplate and guitar body for an electric guitar which allows one to quickly and easily change the appearance, the sounds, the tones and the resonance of the electric guitar. The interchangeable, custom-designed faceplate houses all components and electronics needed for an electric guitar solely on the faceplate itself, so that the tone, sound and resonance characteristics of the guitar can be changed simply by substituting alternate interchangeable faceplates. Further, after assembly of the interchangeable faceplate with the guitar body, the unique configuration of the components and electronic wiring on the faceplate, in combination with the guitar body configuration, produce superior and enhanced sounds, tones and resonance when played by a guitar player.

14 Claims, 14 Drawing Sheets

A

B

INTERCHANGEABLE GUITAR FACEPLATE AND GUITAR BODY SYSTEM

CROSS REFERENCE TO RELATED APPLICATIONS

This application claims the benefit under 35 U.S.C. §119 of U.S. Provisional Patent Application No. 62/027,023, filed Jul. 21, 2014, which is incorporated by reference herein in its entirety.

FIELD OF THE INVENTION

The present invention relates to stringed musical instruments and, in particular, to electronic guitar modular faceplates which are interchangeable between guitar bodies.

BACKGROUND OF THE INVENTION

Currently, there are no commercially available guitars that allow for the interchangeability of faceplates to create unique aesthetic and tonal combinations without having to change the body of the guitar, the electronics of the guitar, or the guitar entirely.

While several guitar makers have created various systems for interchanging faceplates for ornamental purposes, none of them teaches a faceplate capable of having individual sound, tone and resonance functional properties. Additionally, while other guitar makers have created modular faceplate and guitar body systems, such as the RKS Open Architecture guitar, and the interchangeable and modular acoustic and electric guitar apparatus taught by Moghhaddam, none of them uses the faceplate as the modular home for the guitar sounds, tones and resonance characteristics. For instance, the design and system of the guitar faceplate taught by Tanaka is merely ornamental and provides no functional purpose to the tonal characteristics of their guitar; Teuffel teaches modular body faceplates designed specifically to not influence the sound characteristics of the guitar; and Merrick, who teaches faceplates which require electronic assembly and rewiring and which cannot be removed from the body of a guitar without causing permanent damage to the guitar or requiring a guitar technician to carry out modifications and repair work to the guitar.

SUMMARY OF THE INVENTION

The present invention overcomes all the shortcomings of prior art faceplate and guitar body systems by providing an interchangeable, custom-designed guitar faceplate and guitar body for an electric guitar which allows one to quickly and easily change the appearance and functional properties, i.e., the sounds, tones and resonance of the electric guitar. The interchangeable, custom-designed faceplate of the invention houses all components and electronics needed for an electric guitar solely on the faceplate itself, so that the sound and tonal characteristics of the guitar can be changed quickly and easily by substituting alternate interchangeable faceplates. Further, after assembly of the interchangeable faceplate with the guitar body, the unique configuration of the components and electronic wiring on the faceplate, in combination with the guitar body configuration, produce superior and enhanced sounds, tones and resonance when played by a guitar player.

The invention encompasses any number of interchangeable faceplates which are complementary to a guitar body, each of the interchangeable faceplates having a different and distinctive appearance design. Thus, a guitar player is able to purchase one guitar body with a particular design and shape, and then purchase a number of different interchangeable faceplates which are complementary to, i.e., attach perfectly on to, the complementary guitar.

In an aspect of the invention, the interchangeable, custom-designed guitar faceplate and guitar body comprises a faceplate having a top surface, a bottom surface, a head end and a tail end; and a guitar body having a top surface, a bottom surface, a head end and a tail end. The top surface of the faceplate has a plurality of faceplate openings, which are fitted with faceplate components, and the bottom surface of the faceplate comprises electronic wiring components and a plurality of elongated forks. The top surface of the guitar body has a plurality of guitar body openings on the periphery of the top surface, and a central opening. The bottom surface of the faceplate attaches to the top surface of the guitar body, and when the faceplate and the guitar body are fully assembled with all the faceplate components and the electronic wiring components, there is produced superior and enhanced sounds, tones and resonance when played by a guitar player compared to the sounds, tones and resonance of conventional electric guitars.

The plurality of faceplate components includes, without limitation, one or more pickups, each of which fits into the one or more pickup openings; a plurality of bridge pins, each of which fits into each of the plurality of bridge openings for attaching a bridge; a plurality of saddle pins, each of which fits into each of the plurality of saddle pin openings for attaching a saddle bar; a pickup selector switch which fits into the pickup selector switch opening; a volume control potentiometer which fits into the volume control potentiometer opening; a tone control potentiometer which fits into the tone control potentiometer opening; an input jack which fits into the input jack recess opening; a plurality of faceplate screws, each of which fits into each of the plurality of faceplate screw openings; and a plurality of strings, each of which are attached at one end to each of a plurality of tuning pegs and attach at another end to the saddle bar.

In another aspect of the invention, there is provided a method of changing a faceplate on a body of a guitar using the interchangeable faceplate and guitar body described above. The method comprises loosening the guitar strings by turning the tuning pegs of the guitar to decrease the tension of the guitar strings on the saddle bar just enough to allow the saddle bar to unhook from the saddle pins without removing the guitar strings from the tuning pegs; removing the saddle bar from the saddle pins; placing the saddle bar and strings away from the faceplate and guitar body; unscrewing each of the plurality of faceplate screws from each of the plurality of guitar body screw sleeves; removing each of the plurality of faceplate screws from each of the faceplate screw openings; lifting the faceplate from the guitar body; placing a different interchangeable faceplate on top of the guitar body; screwing each of the plurality of faceplate screws through each of the plurality of faceplate screw openings and into each of the plurality of guitar body screw sleeves; attaching the saddle bar into position with the two saddle bar pins; and tightening the guitar strings with the tuning pegs. The design of the present invention provides that each faceplate contains unique combinations of wiring, pickups, control potentiometers, tone and volume potentiometer configurations, input jacks and/or bridge and saddle bar systems, which achieves unique aesthetic and tonal combinations without having to change the body of the guitar, the neck of the guitar, the strings of the guitar or the entire guitar itself. Because all of the electronics are housed solely on the faceplate, this allows for each faceplate to contain discrete and individual wiring patterns, pickups and all variations of electronics which outwardly affect the sound, tone and resonance characteristics of the guitar. This is markedly different from any fabrication of guitar faceplates provided heretofore.

The design of the present invention thus provides a distinct advantage for a user, in that the user need not purchase additional guitars, pedals or other modifications to a variety of guitars in their possession in order to achieve multiple sound profiles or alternate sound characteristics. This allows the user to potentially save significant amounts of money, while at the same time providing unparalleled customization and personalization. This vastly differs from prior art, conventional electric guitars, as no prior art electric guitar or guitar system exists that includes a modular, interchangeable faceplate and guitar body system where the sound properties are unique to the faceplate, allowing for ease of customization. In fact, the speed and ease of being able to change faceplates as provided by the present invention is unparalleled compared to prior art guitar systems, whether their designs are ornamental or functional. This is because the present invention requires no electronic assembly or re-wiring, the faceplates come with prefabricated setups that are ready immediately for assembly, and the designs of the individual interchangeable faceplates include all components on the faceplate itself. In addition, the faceplate design of the present invention is completely removable, i.e., not a permanent modification to a guitar.

BRIEF DESCRIPTION OF THE DRAWINGS

A fuller understanding of the invention can be gained from the following description when read in conjunction with the accompanying figures, where like reference numerals refer to identical or functionally similar elements throughout the separate views, which illustrate some, but not the only and exclusive, examples of embodiments of the invention and, as such, the figures disclosed herein are to be considered illustrative rather than limiting. In the drawings.

DETAILED DESCRIPTION OF THE INVENTION

Figure 1:
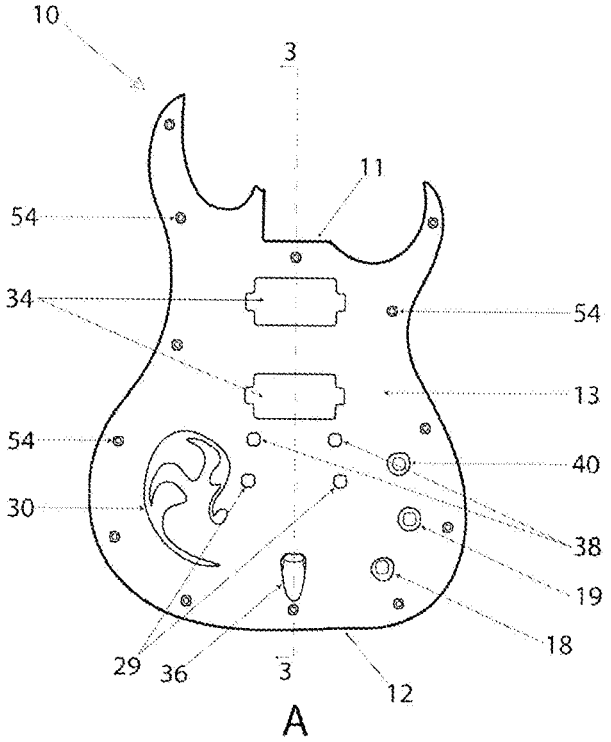
FIG. 1 is a top plan view of the faceplate (A) and guitar body (B) with no electronics installed, in accordance with the embodiments of the present invention.
Figure 1:
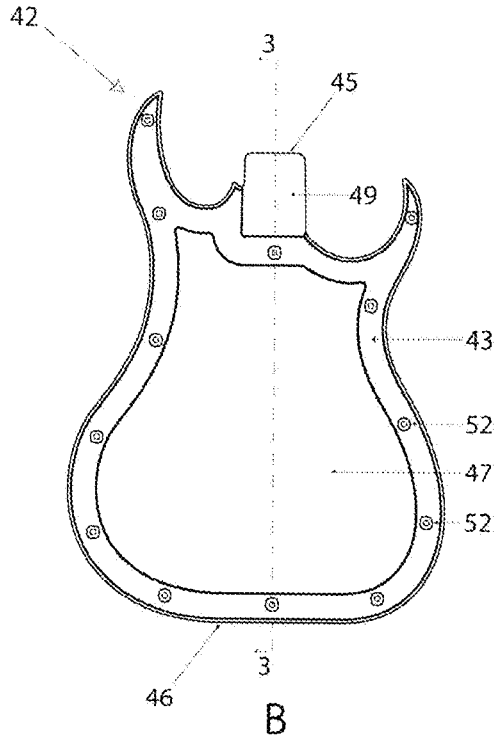

Referring now to FIGS. 1-14, the interchangeable custom-designed guitar faceplate and guitar body is shown generally throughout as 10 and 42, respectively.

FIG. 1A shows the top surface of a faceplate having a head end 11 and a tail end 12, and openings in the faceplate 10, each of the openings configured to receive a faceplate component. The faceplate openings include one or more pickup openings 34 (two shown), two bridge openings 38, two saddle bar openings 29, a pickup selector switch opening 31, a tone control potentiometer opening 18, a volume control potentiometer opening 19, an input jack recess opening 36, a plurality of faceplate screw openings 54, and a sound hole 30.

FIG. 1B shows the top surface 43 of the guitar body 42, which has a head end 45 and a tail end 46. A sloped platform (not shown) is located where the neck 49 mounts to the guitar body 42 at the head end 45. The top surface 43 has a plurality of guitar body openings on its periphery, or screw sleeves 52, and a central opening 47. In different embodiments, the central opening 47 may be configured, without limitation, as a hollow body opening, a semi-hollow body opening, or a chambered body.

FIG. 2A shows the bottom surface 14 of the faceplate 10 containing the faceplate holes 54, the two pickup openings 34, the pickup selector switch opening 31, the tone control potentiometer opening 18, the volume control potentiometer opening 19, the input jack recess opening 36, the plurality of faceplate screw openings 54, and the sound hole 30. In addition, the bottom surface 14 of the faceplate includes two elongated "tuning" forks 56 and electronic wiring (shown in FIG. 4). FIG. 2B shows the bottom surface 44 of the guitar body 42.

Figure 2:
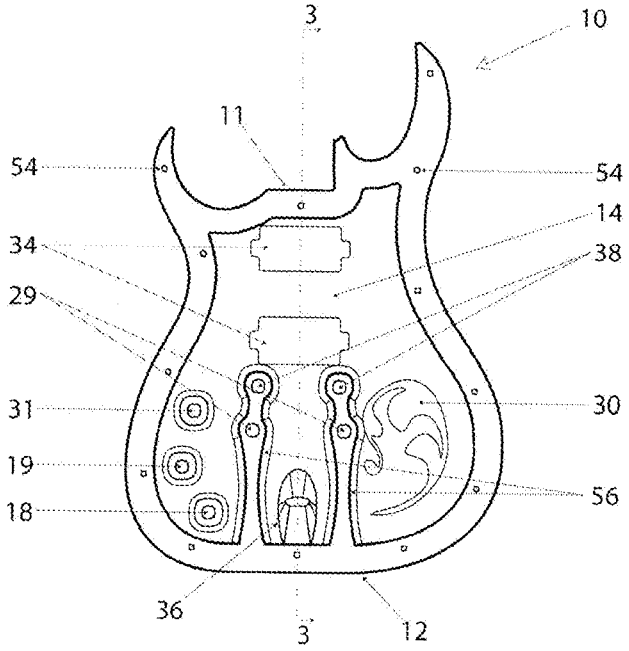
FIG. 2 is a bottom plan view of the faceplate (A) and guitar body (B) with no electronics installed, in accordance with the embodiments of the present invention.
Figure 2:
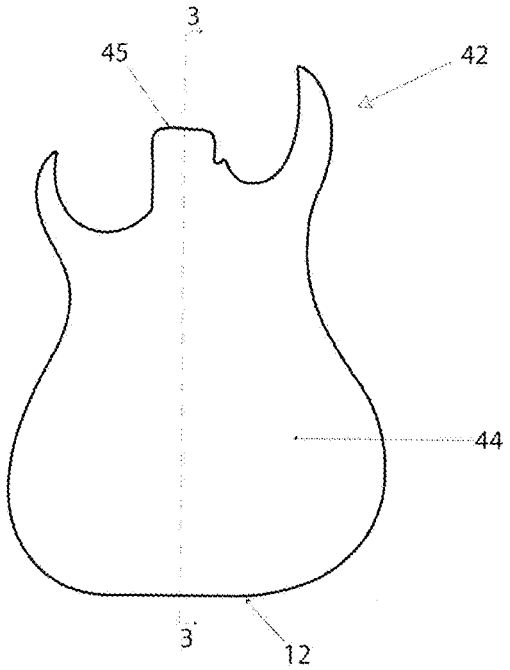
Figure 3:
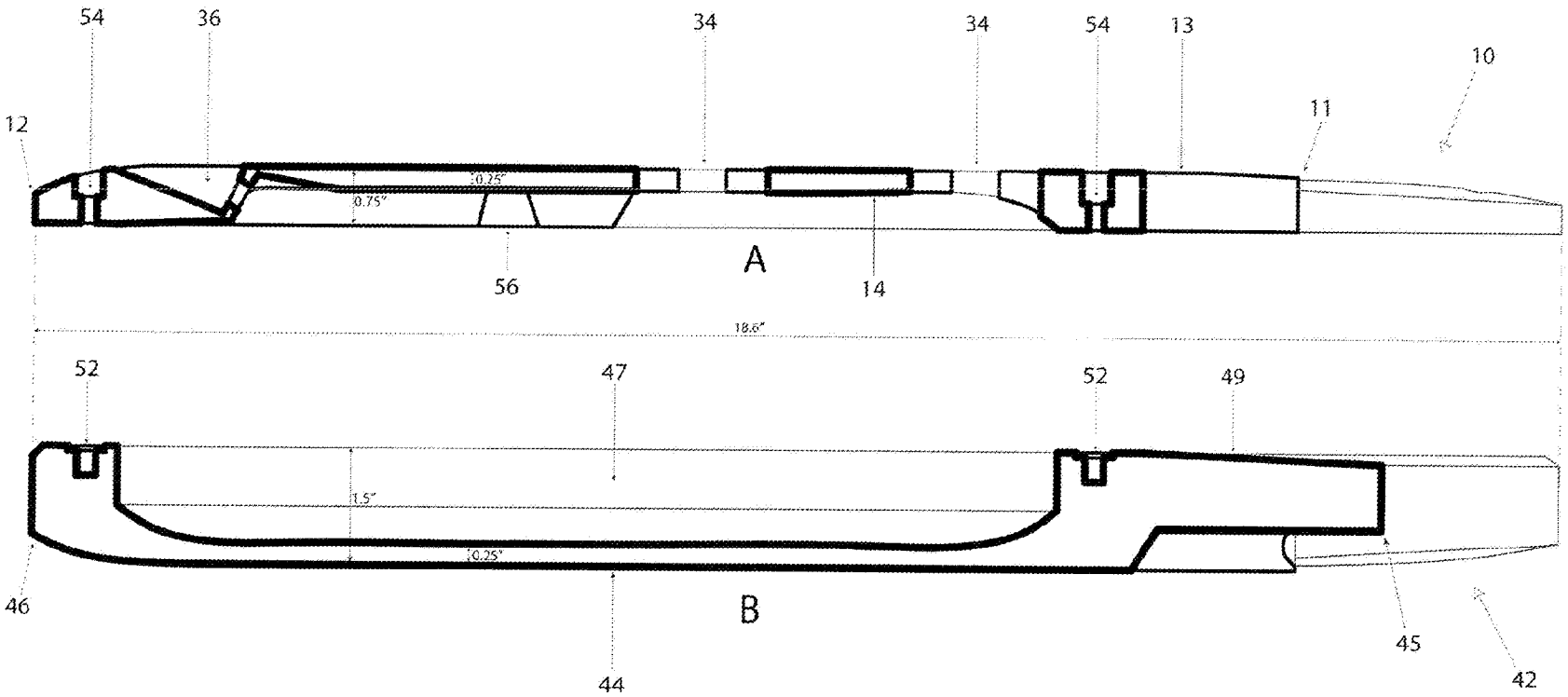
FIG. 3 is a cross-sectional view taken along line 3-3 of FIGS. 1 and 2 of the faceplate (A) and the guitar body (B), in accordance with the embodiments of the present invention.

FIG. 3 is a cross section of the faceplate 10 and guitar body 42, respectively, taken through line 3-3 of FIGS. 1 and 2. As shown in FIG. 3A, the thickness of the faceplate 10 ranges from about 0.25 inches to about 4.0 inches in regions where the input jack 20, tuning forks 56 and two pickups 16 are located. In an embodiment, the thickness of the faceplate 10 where the input jack 20, the tuning forks 56, and two pickups 16 are located is about 0.75 inches. In regions where no components are located on the faceplate 10, the thickness of the faceplate 10 ranges from about 0.1 inch to about 1.0 inch. In an embodiment, the thickness of the faceplate 10 in regions where no components are located on the faceplate 10 is about 0.25 inches. As shown in FIG. 3B, the thickness of the guitar body 42 from the top surface 43 to the bottom surface 44 ranges from about 0.25 inches to about 6.0 inches. In an embodiment, the thickness from the top surface 43 to the bottom surface 44 is about 1.5 inches. In the region where the central opening 47 is located, the thickness of the guitar body 42 is about 0.1 inch to about 1.0 inch. In an embodiment, the guitar body 42 thickness in the region where the central opening 47 is located is about 0.25 inches.

Figure 4:
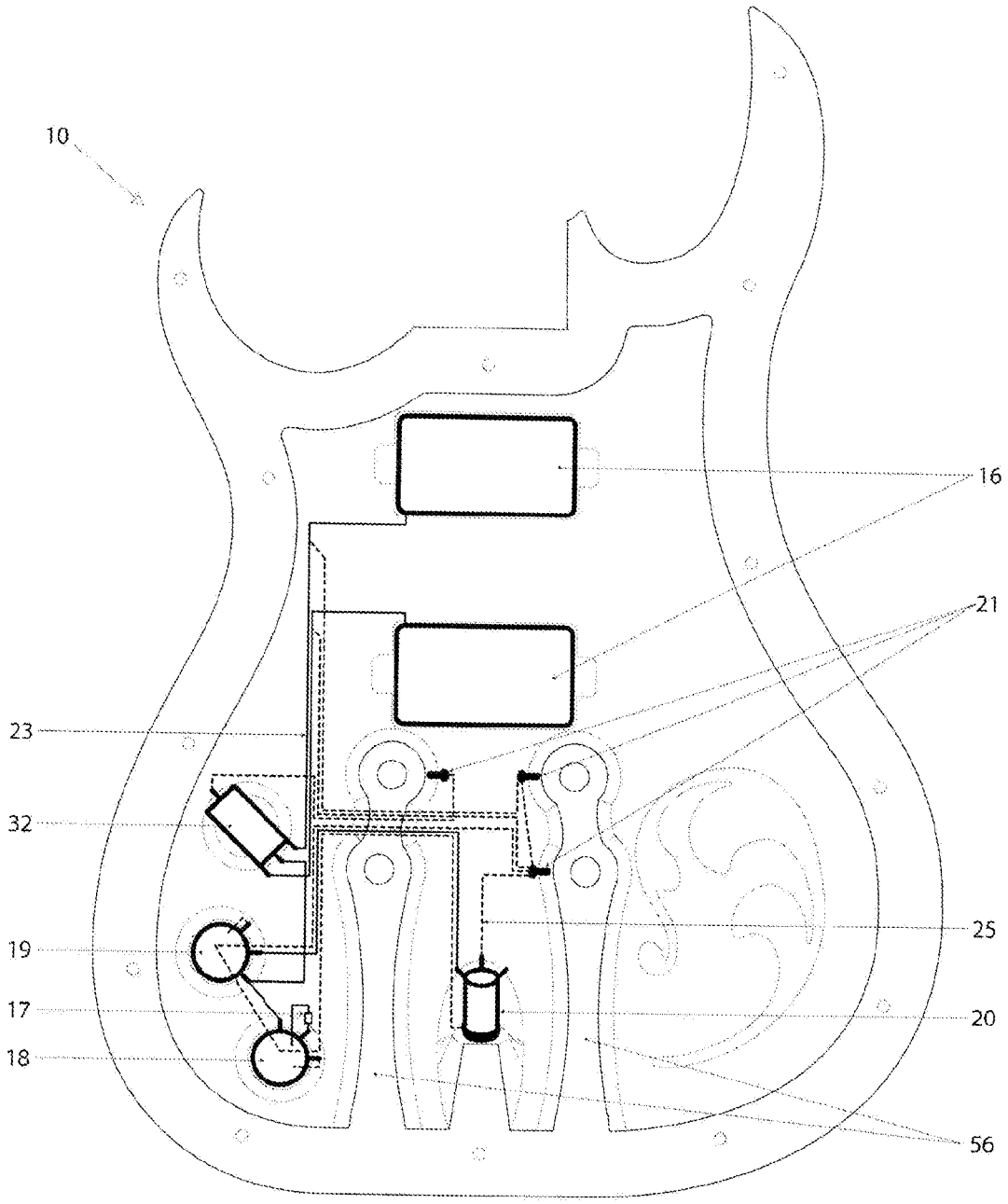
FIG. 4 is a bottom plan view of the faceplate with electronics installed, in accordance with the embodiments of the present invention.
Figure 5:
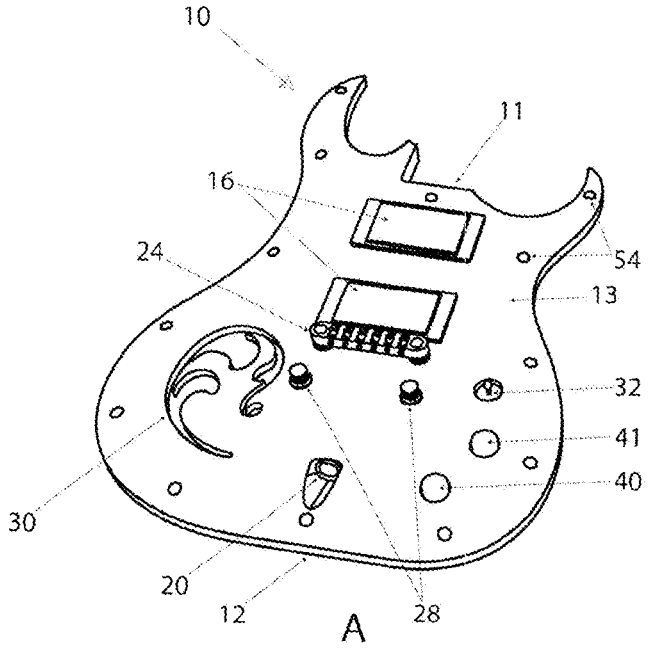
FIG. 5 is a frontal perspective view of the faceplate (A) and guitar body (B) separated with all electronics installed, in accordance with the embodiments of the present invention.
Figure 5:
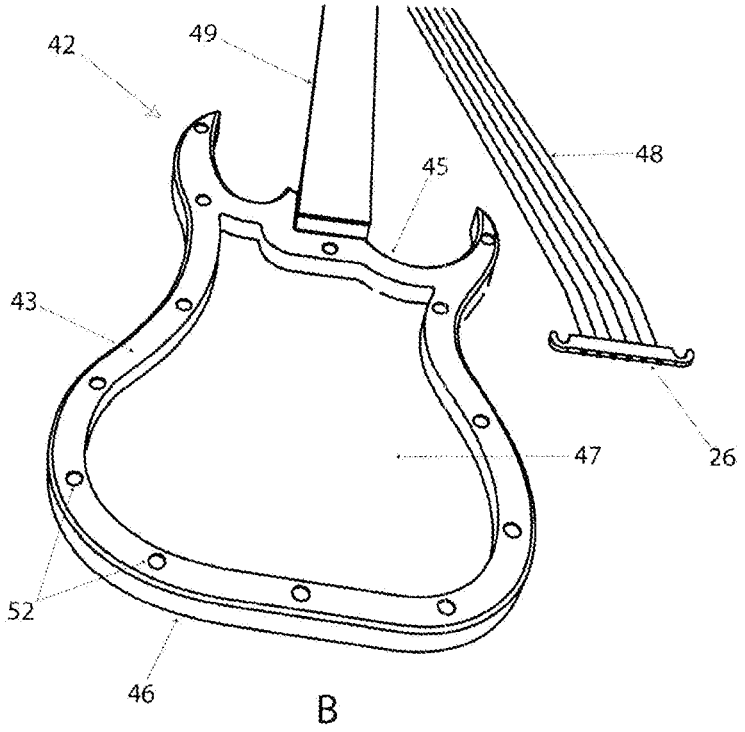
Figure 6:
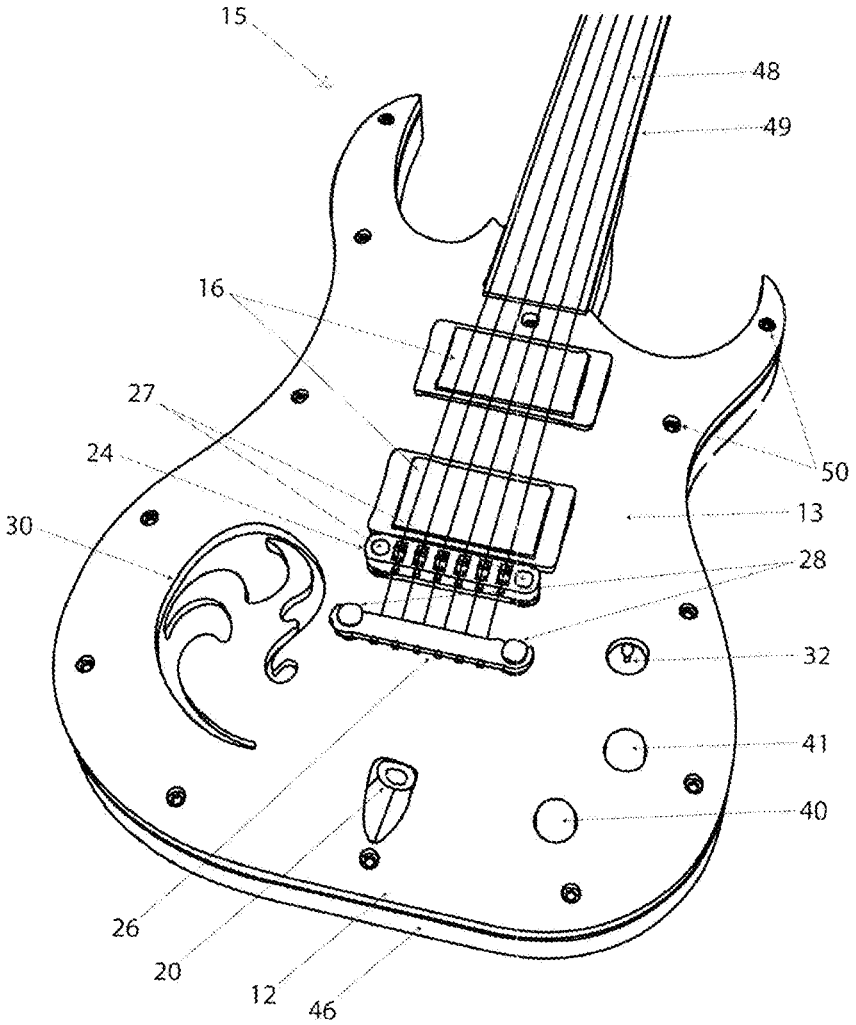
FIG. 6 is a frontal perspective view of the faceplate (A) and body (B) fully assembled, in accordance with the embodiments of the present invention.

As shown in FIG. 4, the bottom surface 14 of the faceplate 10 contains a proprietary electronic wiring assembly for producing the superior and enhanced sounds, tones and resonance of the assembled guitar 15 (shown in FIG. 6). The electronic wiring of the faceplate 10 includes one or more live wires 23, a capacitor 17, one or more ground wires 25, and a plurality of grounding pins 21 (three shown). In addition, the electronic wiring includes resistors, transistors, and other components that affect electrical signals (not shown). The bottom surface 14 of the faceplate 10 also includes two elongated, or tuning, forks 56, an input jack 20 and one or more pickups 16 (two shown).

As one skilled in the art is well aware, one of the most pervasive problems with hollow body and semi-hollow body electric guitars is the amount of feedback that is produced by the guitar when played, resulting in either a high pitched shriek or a buzzing sound when the guitar is plugged into an amplifier. These undesired and unpleasant sounds are referred to as feedback.

Although the sound produced by an electric guitar is the result of the pickups detecting the movement of electromagnetic fields caused by the vibration of the strings, another element that serves to modify the sound is the structural vibration of the guitar itself that occurs when the strings are strummed. When these vibrations reach excessive levels (i.e., gain) at a particular frequency, these vibrations can magnify the electrical signal generated by the electronic components within the electric guitar, producing an audible sound—either the shriek or hum mentioned above. The reason feedback is more pervasive in hollow body and semi-hollow body guitars is two-fold. First, the hollow chamber within which all the electronics are located allows these vibrations to bounce around inside the chamber; and second, because all the electronics are located inside the same chamber, they are all open or exposed to these bouncing vibrations.

Referring back to FIG. 4, the present invention substantially eliminates this excessive gain in the electrical signals caused by these structural vibrations. This is achieved by transferring the increase in the electrical signal into the material of the guitar body 42 itself through the one or more grounding wires 25 connected to the plurality of grounding pins 21 before the electrical signal leaves the electric guitar through the input jack 20. As shown in FIG. 4, each electronic component of the guitar is connected directly to one of these grounding pins 21 as well as to each-other. This serves to reduce the excessive electrical signal that builds up within the electronic components, as well as to ground any excess electrical signal into the guitar body 42 itself.

The electronic wiring assembly of the present invention is so effective that even with a hollow body or semi-hollow body, played with high volume or high gain through an amplifier, substantially no feedback is produced, allowing players of the assembled faceplate and guitar body the ability to fully express their musical creativity without any restrictions.

The components which fit into the openings of the faceplate 10 and guitar body are shown in FIGS. 5-13. The components include the one or more pickups 16 (two shown), each one or more pickups 16 configured to fit into each of the one or more pickup openings 34; a plurality of bridge pins 27 (two shown), each of which fits into each of the plurality of bridge openings 38 for attaching a bridge 24; a plurality of saddle pins 28 (two shown), each of which fits into each of the plurality of saddle pin openings 29 for attaching a saddle bar 26; a pickup selector switch 32 which fits into the pickup selector switch opening 31; a tone control potentiometer 40 which fits into the tone control potentiometer opening 18; a volume control potentiometer 41 which fits into the volume control potentiometer opening 19; ab input jack 20 which fits into the input jack recess opening 36; a plurality of faceplate screws 50, each of which fits into each of the plurality of faceplate screw openings 54 and screw into each of the plurality of guitar body screw sleeves 52; and a plurality of guitar strings 48, each of which are attached at one end to each of a plurality of tuning pegs (not shown) and attach at their other end to the saddle bar 26.

The faceplate 10 and guitar body 42 of the invention have a complementary shape, best shown in FIGS. 1-6. Attachment of the faceplate 10 to the guitar body 42 is accomplished by matching up their complementary shapes, i.e., placing the bottom surface 14 of the faceplate 10 on top of the top surface 43 of the guitar body 42, and then screwing in the faceplate screws 50 through the faceplate screw holes 54 and into the guitar body screw sleeves 52. In an embodiment, the faceplate screws 54 are, without limitation, 3/16 inch hex screws, the faceplate screw openings 54 are, without limitation, 3/16 inch diameter openings, and the guitar body screw sleeves 52 have, without limitation, a diameter of 3/16 inches.

The invention provides that when all of the components of the faceplate 10 and guitar body 42 are affixed in their respective locations and the faceplate is attached to the guitar body 42, as described above, the assembled guitar 15 is capable of producing superior and enhanced sounds, tones and resonance when played by a guitar player.

Attachment of one interchangeable faceplate for an alternate interchangeable faceplate of the invention is accomplished by performing the following steps, shown generally in FIGS. 7-13.

Figure 7:
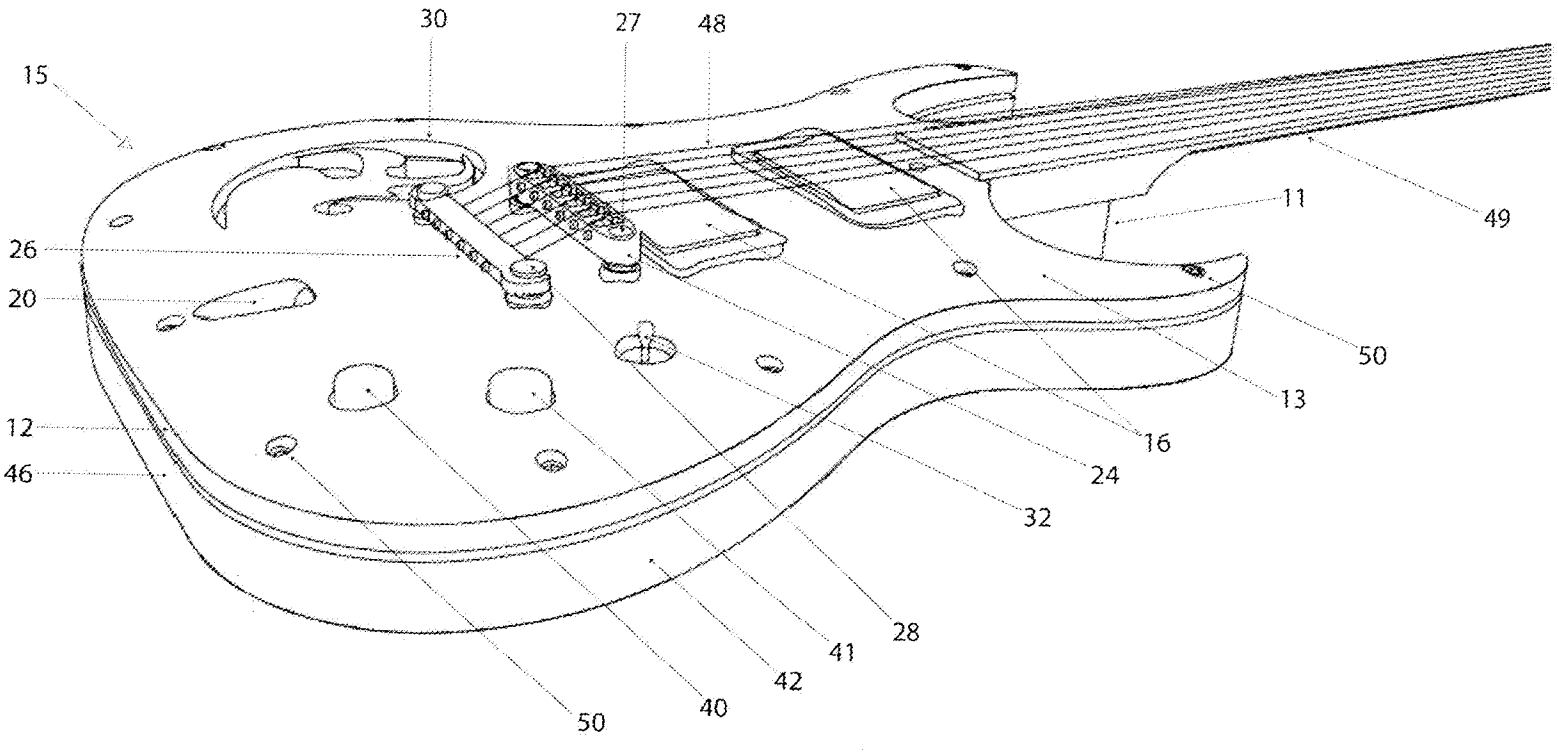
FIG. 7 is a perspective view of a guitar with an interchangeable faceplate after the guitar strings have been loosened, prior to changing the faceplate on the guitar, in accordance with the embodiments of the present invention.
Figure 8:
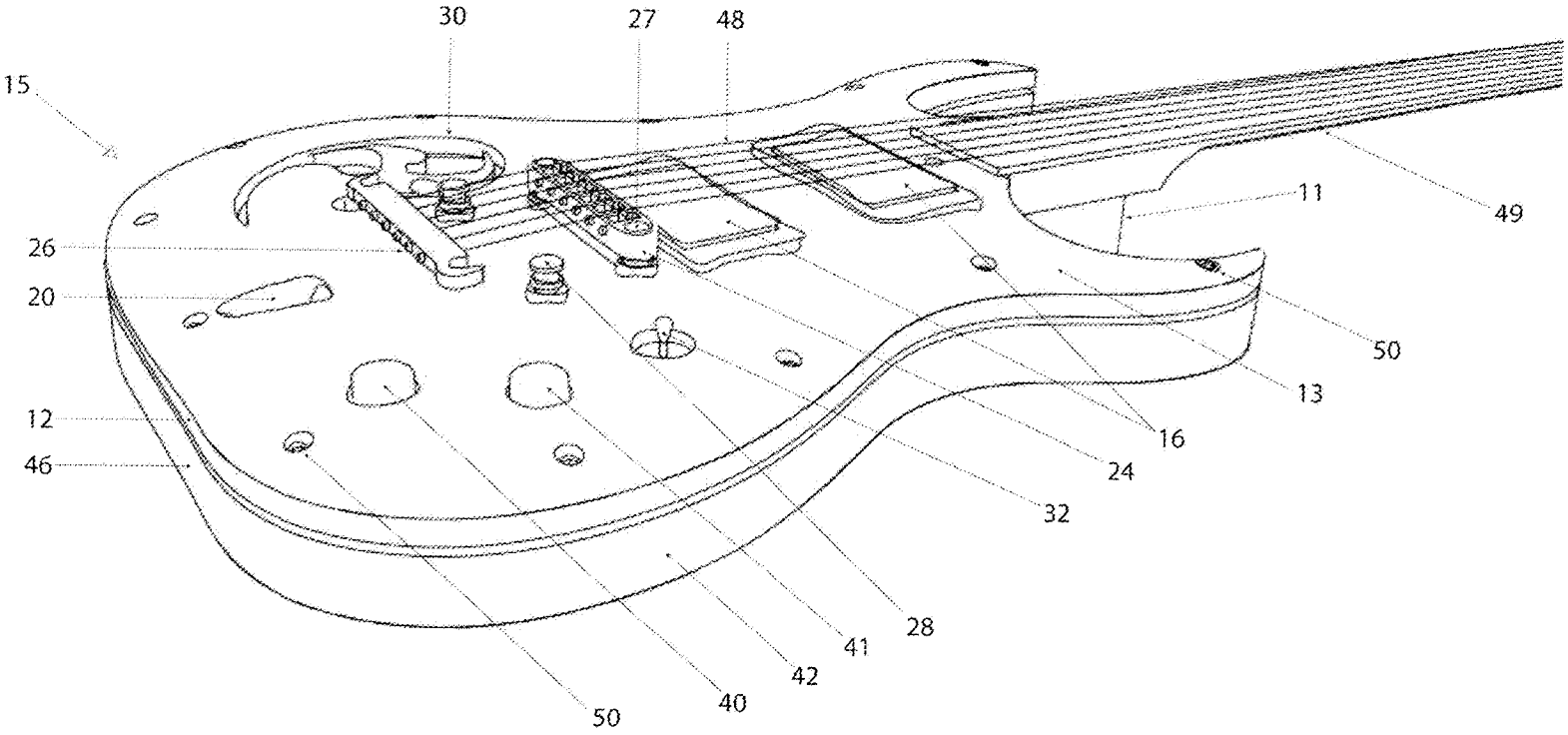
FIG. 8 is a perspective view of a guitar with an interchangeable faceplate with its stop bar pulled away from the saddle pins, in accordance with the embodiments of the present invention.
Figure 9:
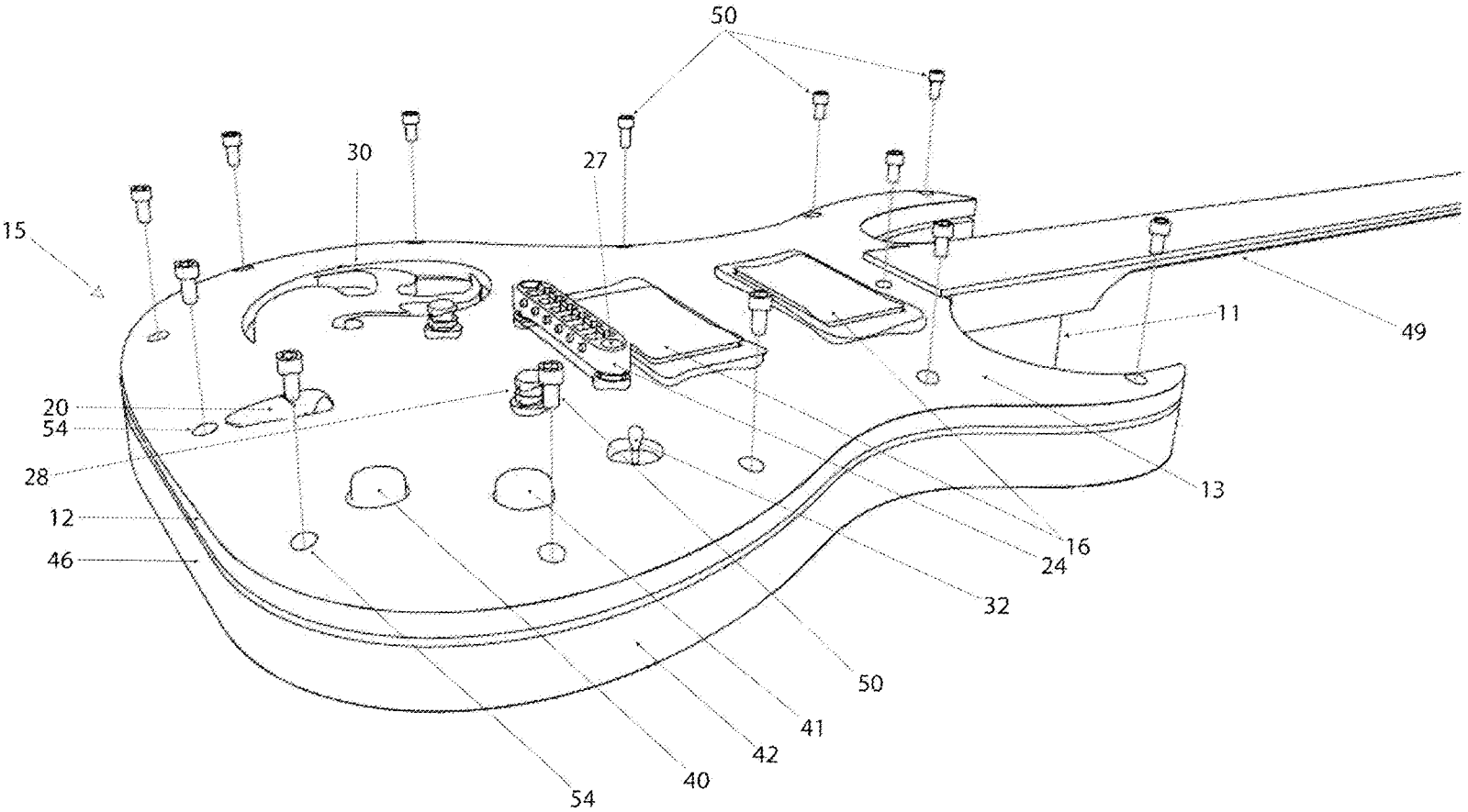
FIG. 9 is a perspective view of a guitar with an interchangeable faceplate showing the retaining screws being removed from the faceplate, in accordance with the embodiments of the present invention.
Figure 10:
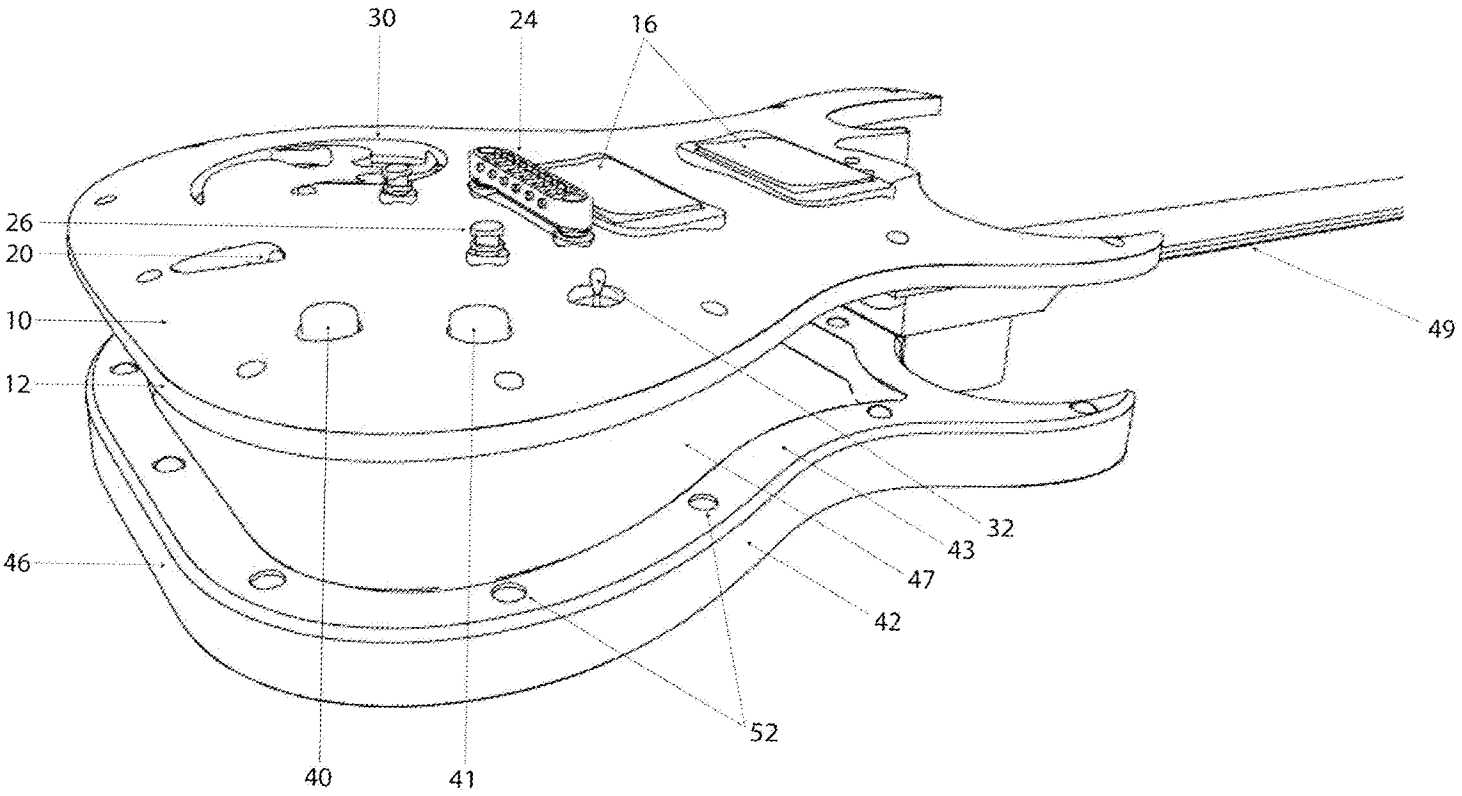
FIG. 10 is a perspective view of a guitar with an interchangeable faceplate showing the faceplate lifted off of the guitar body, in accordance with the embodiments of the present invention.
Figure 11:
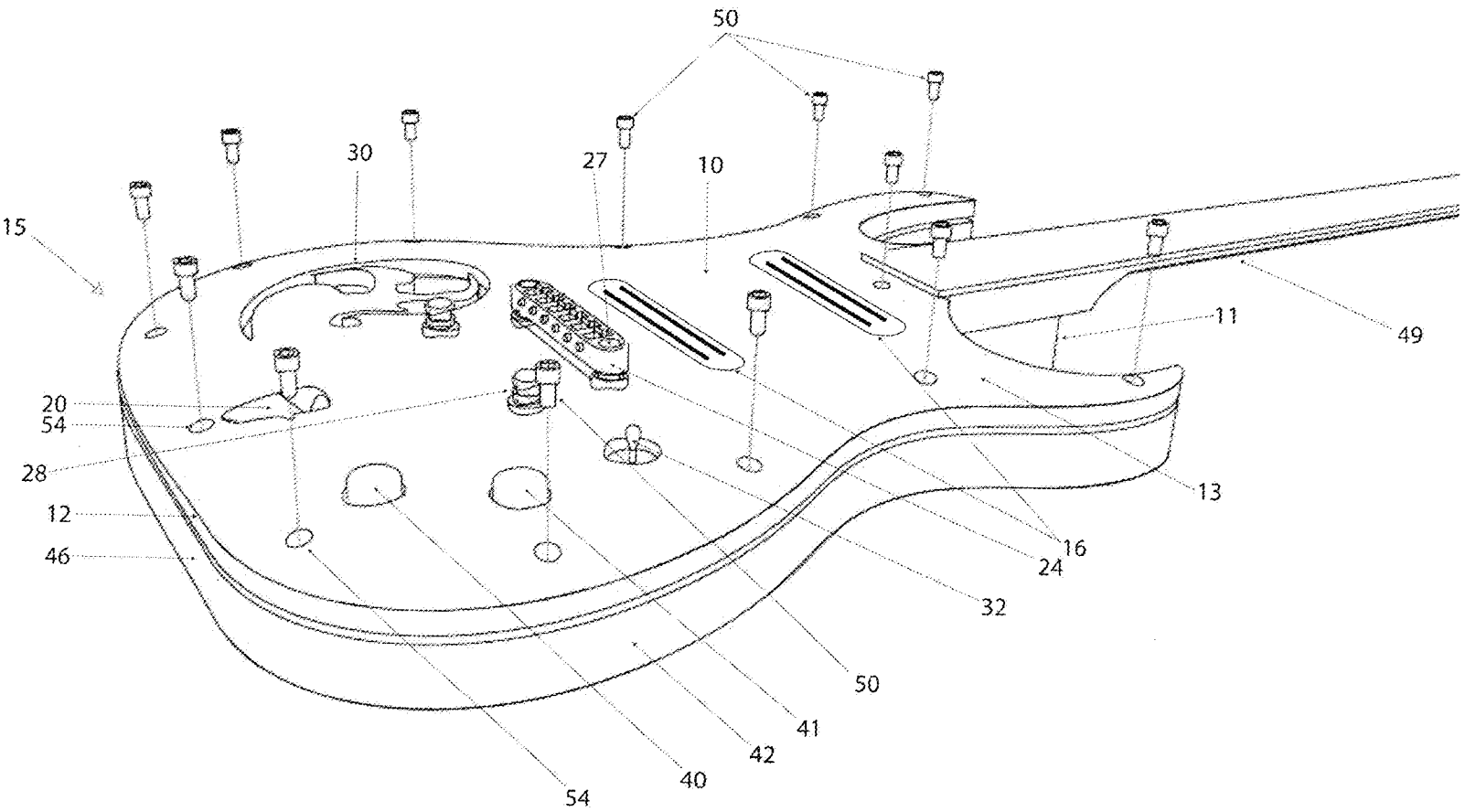
FIG. 11 is a perspective view of a guitar with an interchangeable faceplate illustrating a new faceplate being aligned with the guitar body for insertion and tightening of the retaining screws, in accordance with the embodiments of the present invention.
Figure 12:
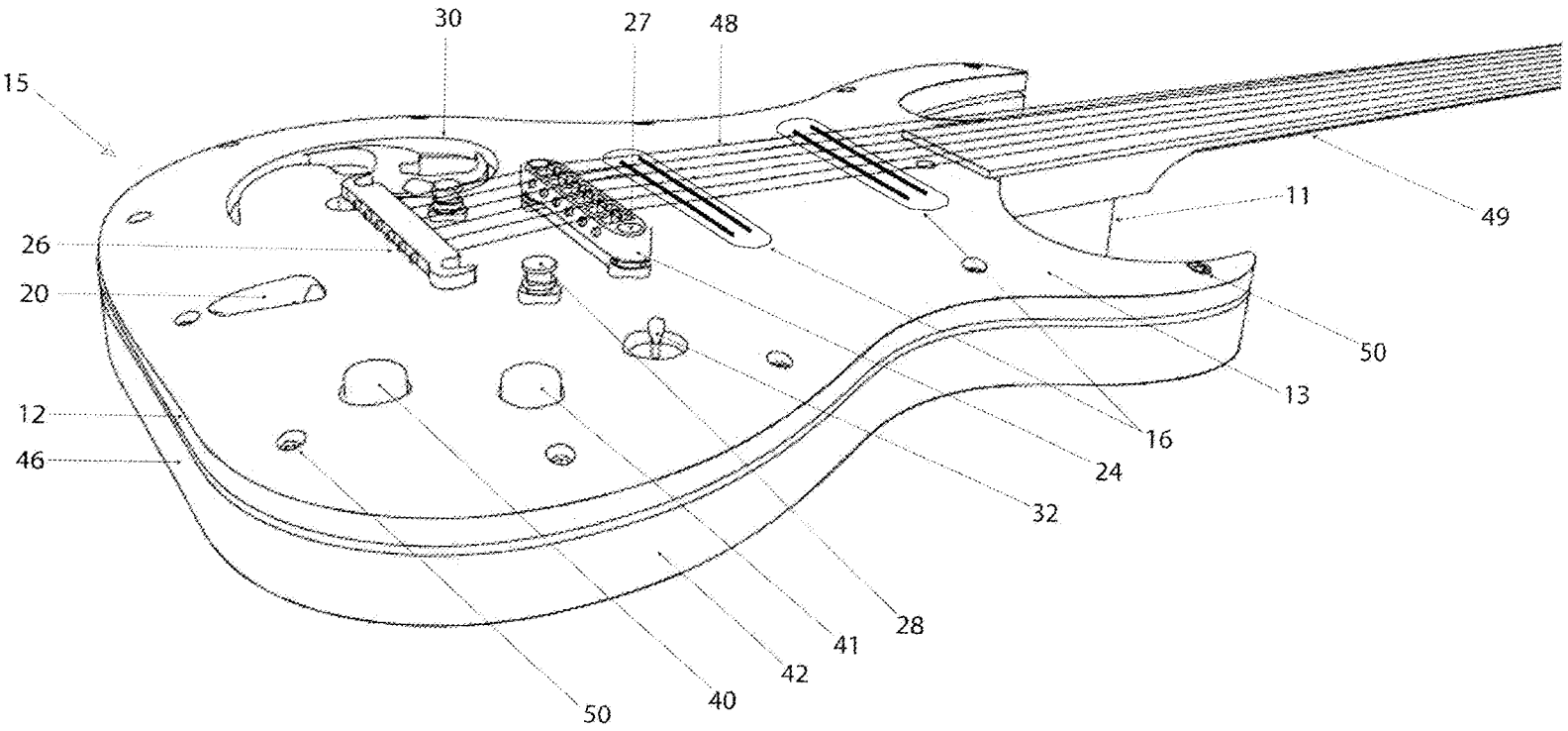
FIG. 12 is a perspective view of a guitar with an interchangeable faceplate after the retaining screws have been tightened, showing the stop bar with guitar strings being aligned over the bridge and guitar body, in accordance with the embodiments of the present invention.
Figure 13:
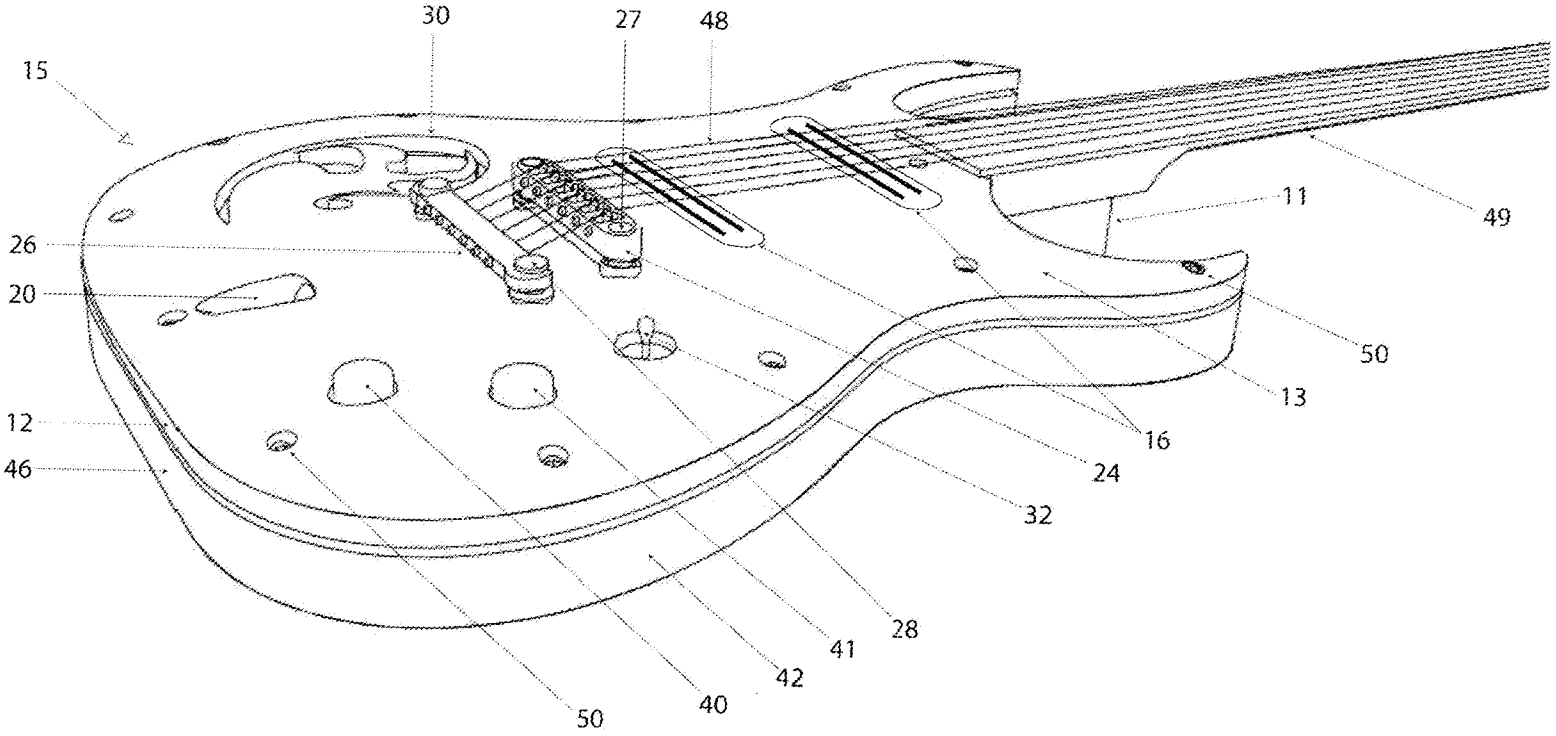
FIG. 13 is a perspective view of a guitar with an interchangeable faceplate after the stop bar is placed on the saddle pins and the strings have been tightened and tuned, in accordance with the embodiments of the present invention.

FIG. 7 shows an assembled guitar 15 having a particular faceplate 10. First, the guitar strings 48 are loosened by turning the tuning pegs (not shown) located at the head end of the guitar body 45 in a direction which decreases the tension of the guitar strings 48 just enough so that the tension on the saddle bar 26 having the guitar strings 48 attached thereto is decreased so that the saddle bar 26 can be unhooked from the saddle pins 28 (shown generally in FIG. 8). Both the saddle bar 26 and the strings 48 then can be removed easily from the top surface 14 of the faceplate 10 and placed to the side of the faceplate 10 and guitar body 42. In this step, the guitar strings 48 never are removed from the tuning pegs. Next, as shown generally in FIG. 9, each of the plurality of faceplate screws 50 are unscrewed from each of the guitar body screw sleeves 52 and removed gently from each of the plurality of faceplate screw openings 54. Then, as shown generally in FIG. 10, the faceplate 10 is lifted from the guitar body 42, a bottom surface of a different, desired faceplate 10' is placed on top of the top surface 43 of the guitar body 42 and the steps are reversed, i.e., screwing back tightly each of the plurality of faceplate screws 50 through each of the plurality of faceplate screw openings 54 and into each of the plurality of guitar body screw sleeves 52 (shown generally in FIG. 11); attaching the saddle bar 26 back into position with the two saddle bar pins 28 (shown generally in FIG. 12) and tightening the guitar strings 48 with the tuning pegs, after which the assembled guitar 15 with the alternate faceplate 10' (shown generally in FIG. 13) is tuned.

The invention encompasses any number of interchangeable faceplates, each of which has a distinctive appearance design and shape, in which the shape is complementary to the shape of a matching guitar body. Thus, a guitar player has the advantage and cost-effectiveness of owning one guitar body with a particular design and shape, and then purchasing a number of different faceplates which are matched, i.e., complementary, to that particular guitar.

Any suitable pickup known by those skilled in art is contemplated for use in the interchangeable faceplate of the invention, such as, without limitation, single coil, humbucker, mini humbucker, double humbucker, hot rail, active, passive and the like. Each type of pickup has a unique sound and tone. Thus, the overall quality of the sound and tone of the assembled guitar of the invention depends on, and differs with, in large part, on the type of pickup, as well as the particular electronic wiring, provided in any particular faceplate attached to the guitar body. However, no matter which type of pickup or electronic wiring is contained in any particular faceplate, each faceplate of the invention, when assembled to its complementary guitar body, produces superior and enhanced sounds, tones and resonance when played by a guitar player.

The faceplate and guitar body of the invention is manufactured from materials which include, without limitation, plastic, hardwood, engineered wood products such as, without limitation, medium density fibreboard (MDF), plywood, stamp board, and any other material that can be cut, shaped, 3-D printed, or forged. The invention contemplates that both the faceplate and the guitar body are made either of the same or different materials.

Figure 14:
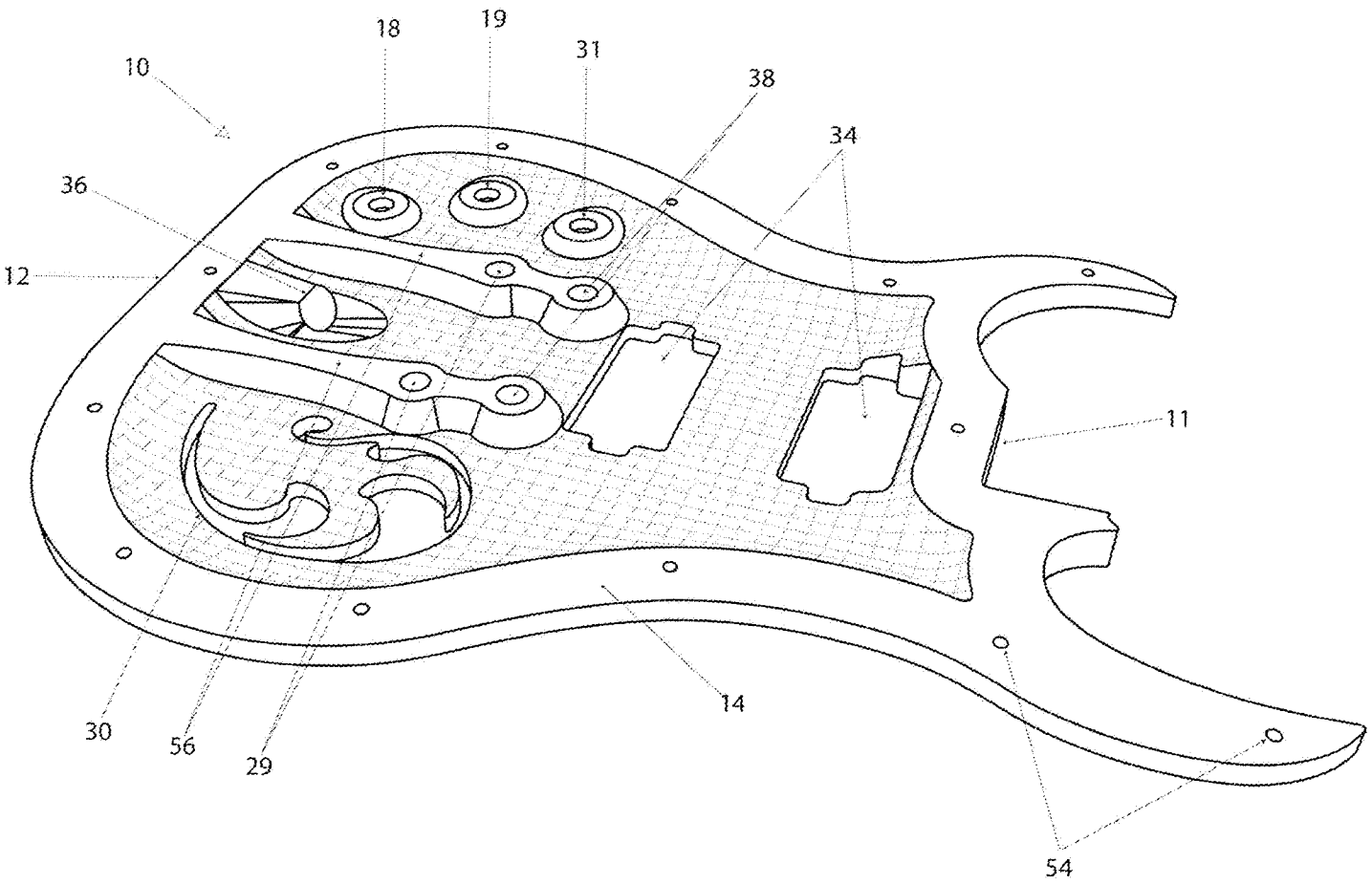
FIG. 14 is a perspective view of the bottom of the faceplate with no electronics installed showing thickness contours of the faceplate, in accordance with the embodiments of the present invention.

The bottom surface 14 of the faceplate 10 is described with more particularity below and is shown in FIG. 14, which includes cross-hatching to illustrate thickness contours of the faceplate 10, which increases gradually from the center of the faceplate 10 to the periphery. The two bridge openings 38 and two saddle bar openings 29 are shown where the bridge 24 and the saddle bar 26 are anchored on the top surface 13 of the faceplate (shown in FIGS. 5-13). The bridge 24 and the saddle bar 26 anchor the ends of the guitar strings 48. In addition, the bridge 24 and the saddle bar 26 transfer the vibrations of the strings 48 into the two elongated tuning forks 56, referred to as such because they behave very similar to tuning forks.

In addition, the region of the faceplate 10 surrounding the two elongated tuning forks 56 is substantially thinner than other regions of the faceplate 10, which allows the two elongated tuning forks 56 to vibrate when the guitar strings 48 (shown in FIGS. 5-13) are strummed. In effect, therefore, the thinner region of the faceplate 10 surrounding the two elongated tuning forks 56 acts similar to a diaphragm, with the vibrations of the strings 48 transferred into this thinner region of the faceplate 10, so that the faceplate 10 vibrates. Because the tuning forks 56 of the faceplate 10 are able to efficiently transfer vibrations of the guitar strings 48 into the thinner region of the faceplate 10 so effectively, the vibration of the faceplate 10 then is transferred back to the guitar strings 48, prolonging the vibration of the strings 48, and therefore the length of time that a string vibrates without being strummed again. This phenomenon is called "sustain," with the interchangeable faceplate of the invention able to create an audible tone which lasts over one minute before the vibrations cease, substantially longer than conventional electric guitar vibrations.

The vibration of the faceplate also may produce feedback, which occurs when vibrations in the thinner region of the faceplate as well as the guitar body reach certain frequencies so that electrical signals within the electronic components are magnified, as discussed above. The electronic wiring design of the invention described above handles this excess electrical signal effectively. In addition, these excess vibrations produced within the guitar body and the thinner regions of the faceplate membrane serve a positive function, as they serve to "color" or affect the tonal quality of the assembled electric guitar of the invention. Thus, the unique physical characteristics of each individual assembled faceplate and guitar body produce unique vibrations, which results in each assembled faceplate and guitar body of the invention to have a unique sound quality or tone. Further, because the configuration of the plurality of interchangeable faceplates of the invention promotes such a high degree of vibration within the faceplate, and because the electronic wiring design can effectively ground out or handle excess, unwanted vibrations which can cause feedback, the assembled faceplate and guitar body of the invention has a tonal quality that is extremely rich compared to conventional electric guitars. This rich, tonal quality is a phenomenon referred to in the musical arts as "resonance," and the invention possesses not only enhanced, but superior resonance, compared to conventional guitars.

Thus, the electronic wiring of the present invention is able to recycle the increased electrical input resulting from feedback back into the wiring and electronic components to boost output of the electric guitar. In addition even when passive pickups are used in the interchangeable faceplate, the assembled faceplate and guitar body has a comparable or higher electrical signal output compared to conventional electric guitars having active pickups. The present invention achieves this surprisingly strong electrical signal output primarily due to the design of the one or more grounding wires, which grounds excess electrical input transferred into the structure of the guitar, while at the same time recycling some of that excess to boost the electrical signal.

It will be appreciated by those skilled in the art that changes could be made to the embodiments described above without departing from the broad inventive concept thereof. It is understood, therefore, that this invention is not limited to the particular embodiments disclosed, but it is intended to cover modifications that are within the spirit and scope of the invention, as defined by the appended claims.

What is claimed is:

1. An interchangeable, custom-designed guitar faceplate and guitar body, comprising:

a faceplate having a top surface, a bottom surface, a head end and a tail end, said top surface having a plurality of faceplate openings which are fitted with faceplate components; said bottom surface comprising electronic wiring components and a plurality of elongated forks; and a guitar body having a top surface, a bottom surface, a head end and a tail end, said top surface having a plurality of peripheral guitar body openings therein and a central opening, wherein the bottom surface of the faceplate attaches to the top surface of the guitar body.

2. The interchangeable, custom-designed guitar faceplate and guitar body of claim 1, wherein the plurality of faceplate openings comprise one or more pickup openings, two bridge openings, two saddle bar openings, a pickup selector switch opening, a tone control potentiometer opening, a volume control potentiometer opening, an input jack recess opening, a plurality of faceplate screw openings, and a sound hole.

3. The interchangeable, custom-designed guitar faceplate and guitar body of claim 1, wherein the central opening is selected from the group consisting of a hollow opening, a semi-hollow opening and a chambered body opening.

4. The interchangeable, custom-designed guitar faceplate and guitar body of claim 1, wherein the plurality of faceplate components comprises one or more pickups, each of which fits into the one or more pickup openings; a plurality of bridge pins, each of which fits into each of the plurality of bridge openings for attaching a bridge; a plurality of saddle pins, each of which fits into each of the plurality of saddle pin openings for attaching a saddle bar; a pickup selector switch which fits into the pickup selector switch opening; a volume control potentiometer which fits into the volume control potentiometer opening; a tone control potentiometer which fits into the tone control potentiometer opening; an input jack which fits into the input jack recess opening; a plurality of faceplate screws, each of which fits into each of the plurality of faceplate screw openings; and a plurality of strings, each of which are attached at one end to each of a plurality of tuning pegs and attach at another end to the saddle bar.

5. The interchangeable, custom-designed guitar faceplate and guitar body of claim 1, wherein the electronic wiring components comprise a live wire, a capacitor, a ground wire, a plurality of grounding pins, resistors, transistors, and other electrical components that affect electrical signals.

6. The interchangeable, custom-designed guitar faceplate and guitar body of claim 1, wherein the plurality of peripheral guitar body openings are a plurality of screw sleeves, wherein each of the plurality of faceplate screws screw into each of the plurality of screw sleeves to attach the faceplate to the guitar body.

7. The interchangeable, custom-designed guitar faceplate and guitar body of claim 1, wherein the faceplate and guitar body is manufactured from materials selected from metals, plastic, hardwood, engineered wood products such as medium density fibreboard (MDF), plywood, stamp board, and any other material that can be cut, shaped, 3-D printed, or forged.

8. The interchangeable, custom-designed guitar faceplate and guitar body of claim 7, wherein the faceplate and the guitar body are made from the same material.

9. The interchangeable, custom-designed guitar faceplate and guitar body of claim 7, wherein the faceplate and the guitar body are made from different materials.

10. The interchangeable, custom-designed guitar faceplate and guitar body of claim 3, wherein the faceplate can have a plurality of appearance designs and shapes.

11. The interchangeable, custom-designed guitar faceplate and guitar body of claim 10, wherein each of the plurality of faceplates has a different appearance, a particular pickup type, and a particular electronic wiring.

12. The interchangeable, custom-designed guitar faceplate and guitar body of claim 3, wherein the one or more pickups are pickup types selected from the group consisting of single coil, humbucker, mini humbucker, double humbucker, hot rail, active and passive pickups.

13. The interchangeable, custom-designed guitar faceplate and guitar body of claim 1, wherein the electronic wiring comprises a plurality of wiring possibilities.

14. A method of changing a faceplate on a body of a guitar using the interchangeable faceplate and guitar body of claim 1, the method comprising:

loosening the guitar strings by turning the tuning pegs of the guitar to decrease the tension of the guitar strings on the saddle bar just enough to allow the saddle bar to unhook from the saddle pins without removing the guitar strings from the tuning pegs;

removing the saddle bar from the saddle pins;

placing the saddle bar and strings away from the faceplate and guitar body while the guitar strings are still attached to the tuning pegs;

unscrewing each of the plurality of faceplate screws from each of the plurality of guitar body screw sleeves;

removing each of the plurality of faceplate screws from each of the faceplate screw openings;

lifting the faceplate from the guitar body;

placing a different interchangeable faceplate on top of the guitar body;

screwing each of the plurality of faceplates screws through each of the plurality of faceplate screw openings and into each of the plurality of guitar body screw sleeves;

attaching the saddle bar into position with the two saddle bar pins; and tightening and re-tuning the guitar strings with the tuning pegs.

* * * * *